US007540364B2

(12) United States Patent
Sanderson

(10) Patent No.: US 7,540,364 B2
(45) Date of Patent: Jun. 2, 2009

(54) TRIGGER LATCH ASSEMBLY

(75) Inventor: David B. Sanderson, Villa Park, CA (US)

(73) Assignee: SKB Corporation, Orange, CA (US)

( * ) Notice: Subject to any disclaimer, the term of this patent is extended or adjusted under 35 U.S.C. 154(b) by 758 days.

(21) Appl. No.: 10/932,602

(22) Filed: Sep. 1, 2004

(65) Prior Publication Data

US 2006/0042897 A1 Mar. 2, 2006

(51) Int. Cl.
*A45C 13/10* (2006.01)

(52) U.S. Cl. ..... 190/119; 190/120; 220/324

(58) Field of Classification Search ..... 215/119–122; 292/DIG. 48, DIG. 49; 190/119–122; 220/324
See application file for complete search history.

(56) References Cited

U.S. PATENT DOCUMENTS 2,792,248 A * 5/1957 Axtell ..... 292/248
2,862,749 A * 12/1958 Burkard ..... 292/165
3,030,137 A * 4/1962 Tomkinson et al. ..... 292/113
3,847,423 A * 11/1974 Gley ..... 292/113
4,181,333 A * 1/1980 Stelma ..... 292/66
4,358,150 A 11/1982 Nash
4,548,435 A 10/1985 Bourne
4,858,970 A 8/1989 Tedesco et al.
4,991,885 A 2/1991 Poe
5,111,918 A * 5/1992 Bako et al. ..... 190/18 A
5,111,920 A * 5/1992 Castelli et al. ..... 190/120
5,257,839 A * 11/1993 Nielsen et al. ..... 292/113
5,271,649 A * 12/1993 Gromotka ..... 292/113
5,638,709 A 6/1997 Clavin
5,924,533 A * 7/1999 Cnockaert et al. ..... 190/18 A
6,513,689 B2 * 2/2003 Vincenzo ..... 224/435
6,640,397 B1 * 11/2003 Gipson ..... 24/191
D483,430 S 12/2003 Teskey
6,955,381 B2 * 10/2005 Parker et al. ..... 292/113

FOREIGN PATENT DOCUMENTS

DE 4022352 A1 * 12/1991
FR 2641952 A1 * 7/1990

* cited by examiner

*Primary Examiner*—Sue A Weaver
(74) *Attorney, Agent, or Firm*—Orrick Herrington & Sutcliffe LLP

(57) ABSTRACT

A trigger latch assembly for releasably securing a latch by pivotal rotation comprising a latch trigger pivotally joined to a rotatable latch cover. The trigger latch assembly may be attached to a variety of devices including luggage type transport cases. A latch trigger biasing member is attached to the latch trigger and also engages the latch cover. The latch trigger has a perpendicularly extending member having a detent which pivotally engages a retaining lip on a device to be latched when downward force is applied to the latch cover which pivotally rotates the latch trigger in cooperation with the biasing member, thereby latching closed the device. The latch is released by pivotably rotating the trigger latch towards the latch cover to displace the detent from engagement with the lip to thereby unlatch the device.

4 Claims, 4 Drawing Sheets

FIG. 3
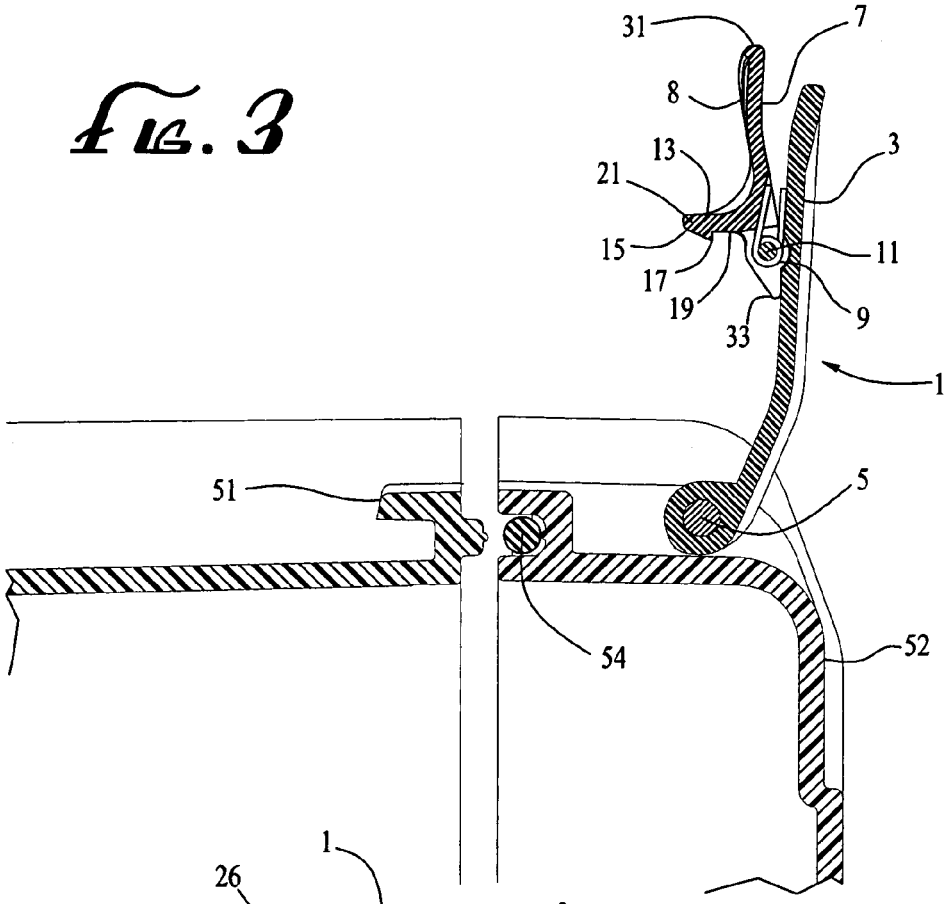
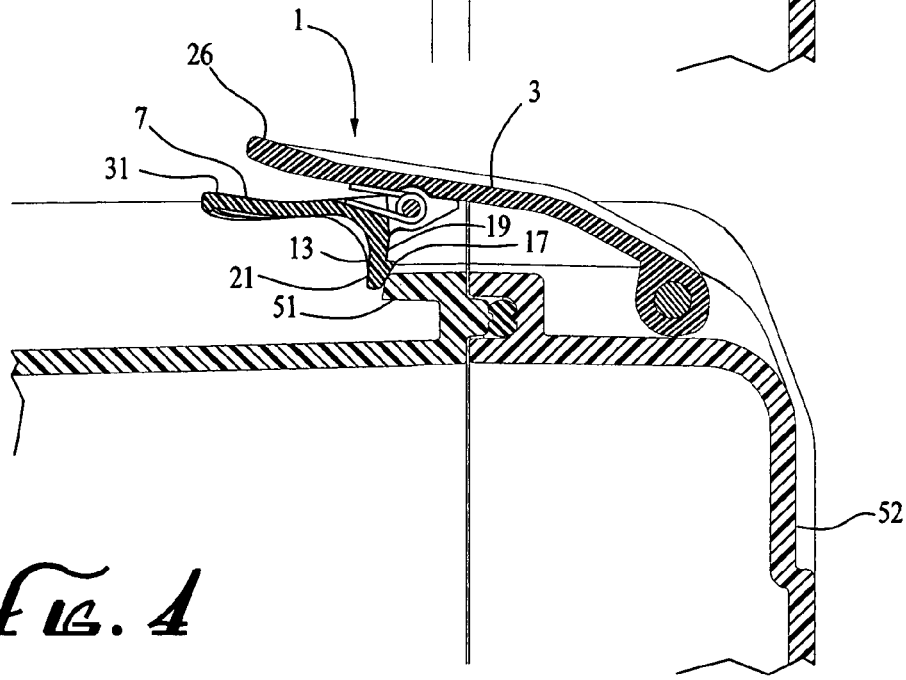
FIG. 4

FIG. 5
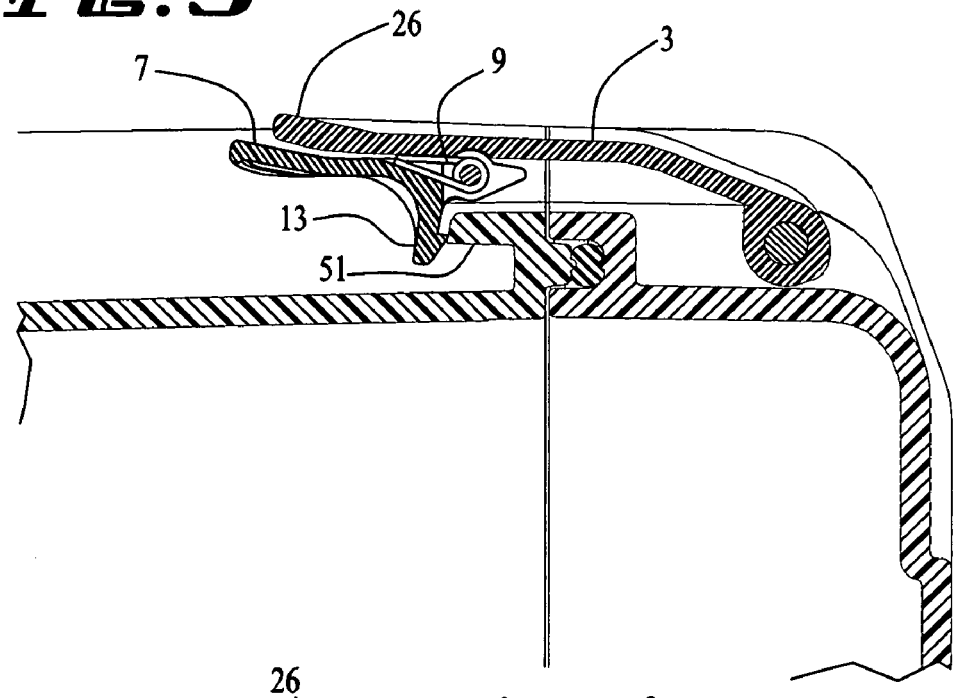
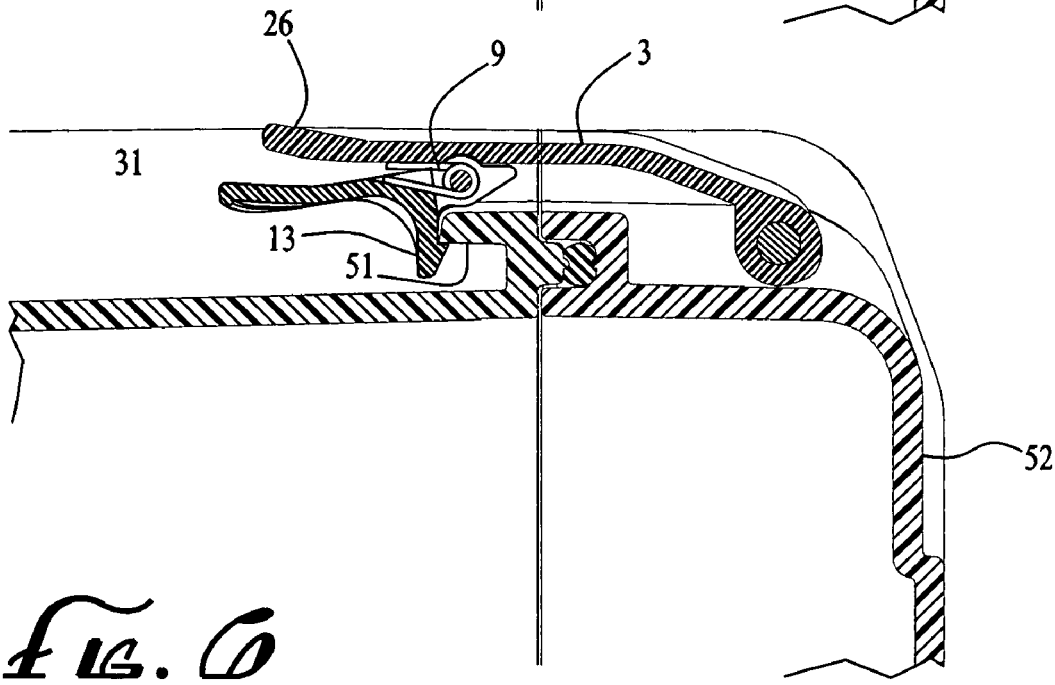
FIG. 6

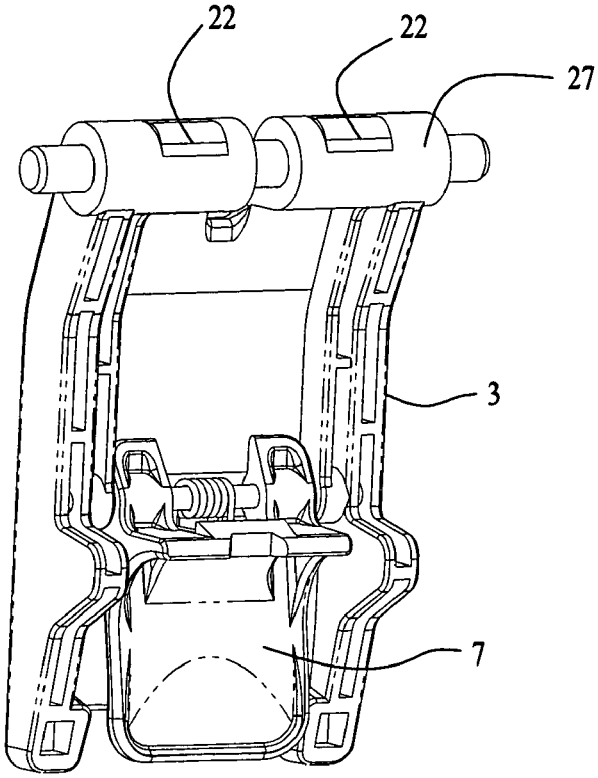
FIG. 7
FIG. 8
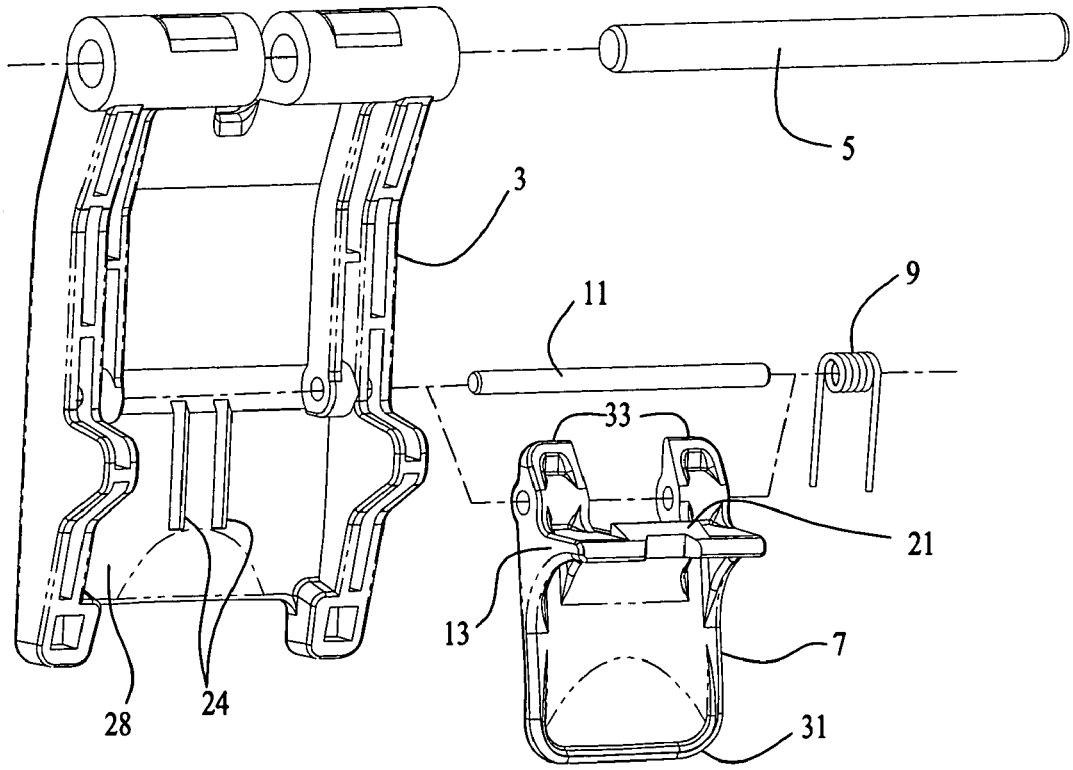

TRIGGER LATCH ASSEMBLY

BACKGROUND OF THE INVENTION

This invention is directed to a trigger latch assembly for releasably latching various items, including transport cases.

SUMMARY OF THE INVENTION

This trigger latch assembly of this invention incorporates a trigger mechanism for easily latching and unlatching various items, including transport or shipping cases. The trigger latch assembly includes a rotatable latch cover privotably attached to a latch trigger in combination with a latch trigger biasing member, and the latch trigger has a detent adapted for securely and releasably engaging a retaining lip on the transport case or other device to be latched. The latch trigger is urged into and out of latching engagement by pivotal rotation of the latch trigger in relation to the latch cover.

BRIEF DESCRIPTION OF THE DRAWINGS

FIG. 3 is a cross-sectional side view of the trigger latch assembly of this invention attached to a transport case in the open position.

FIG. 4 is a cross-sectional side view of the trigger latch assembly attached to a transport case in an unlatched position.

FIG. 5 is a cross-sectional side view of the trigger latch assembly attached to a transport case in a partially unlatched position.

FIG. 6 is a cross-sectional side view of the trigger latch assembly attached to a transport case in the latched position.

FIG. 7 is a bottom view of the trigger latch assembly.

FIG. 8 is an exploded bottom view of the components of the trigger latch assembly.

DETAILED DESCRIPTION OF PREFERRED EMBODIMENTS

Figure 1:
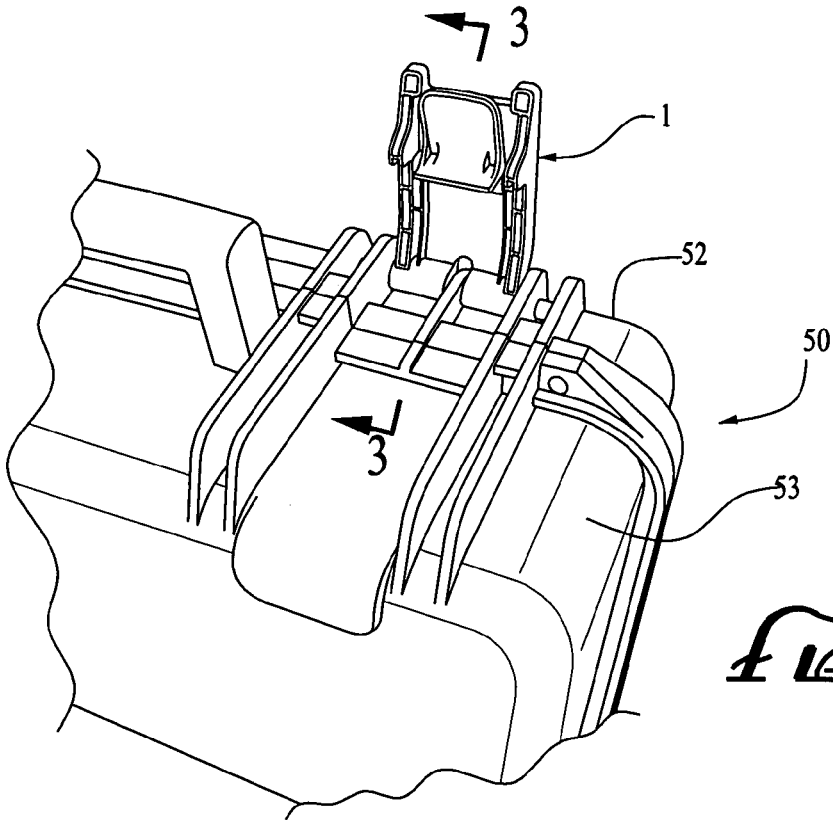
FIG. 1 is a top perspective view of the trigger latch assembly of this invention attached to a transport case and in an open position.
Figure 2:
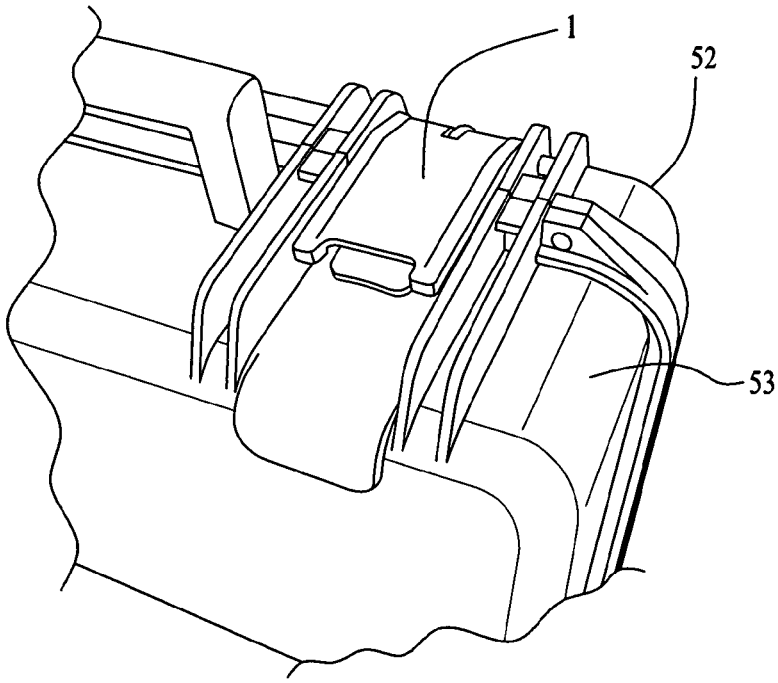
FIG. 2 is a top perspective view of the trigger latch assembly of this invention attached to a transport case and in the latched position.

Turning now in detail to the drawings, FIGS. 1 and 2 generally show the trigger latch assembly 1 of this invention in a preferred embodiment attached to a luggage style transport case 50. The case 50 has a hinged cover portion 52 and a bottom portion 53. The trigger latch assembly 1 is shown in FIG. 1 in an unlatched and open position which allows the hinged cover 52 of the transport case 50 to be opened. In FIG. 2 the trigger latch assembly 1 is shown in the latched position which securely latches together the two portions of the case and prevents the cover 52 of the transport case from being opened.

Referring specifically to FIG. 3, a preferred embodiment of the trigger latch assembly 1 is shown, including latch cover 3 adapted for pivotal movement about a fixed latch cover pivot rod 5, and latch trigger 7. Latch cover pivot rod 5 is secured to the cover 52 of transport case 50, thereby attaching the trigger latch assembly 1 to the case.

Latch trigger 7 is adapted to pivot about a fixed latch trigger pivot pin 11, which is secured to latch cover 3, as shown in FIGS. 3 and 8. A latch trigger biasing member 9, preferably a torsional coil spring, is positioned and preferably coiled about pivot pin 11. As shown in FIG. 3, the latch trigger biasing member 9 bears against both latch cover 3 and latch trigger 7. Biasing member 9 urges the forward portion 31 of latch trigger 7 to pivot away from latch cover 3, and urges the rear portion 33 of the latch trigger 7 toward latch cover 3. As shown in FIG. 8, the underside surface 28 of latch cover 3 may optionally include one or more channels 24 into which may be inserted the portion of biasing member 9 that bears against latch cover 3.

Latch trigger 7 includes a trigger engagement member 13 extending generally perpendicularly from the bottom surface 8 of latch trigger 7 forward of the location of pivot pin 11. The terminating end of trigger engagement member 13 includes a detent 21 comprised of an outwardly protruding sloped surface 15 culminating in latch protrusion 17, as shown in cross-section in FIG. 3.

Latch cover 3 is adapted to pivot between a first predetermined position shown in FIGS. 1 and 3 where the latch assembly is fully open, and a second predetermined position shown in FIGS. 2 and 6 where the trigger latch assembly is engaged and latched closed. In addition, latch cover 3 and latch trigger 7 are adapted to be pivotally attached to each other in the predetermined positions generally shown in FIGS. 3-6. In a preferred embodiment, the trigger latch assembly 1 is attached to transport case 50 so that when latch cover 3 is pivoted forward to the position shown in FIG. 4, the sloped surface 15 of detent 21 on latch trigger engagement member 13 impacts a catch member such as retaining lip 51 on the bottom portion 53 of transport case 50.

One or more surface protuberances or cams 22 may be provided on the rotational end 27 of latch cover 3, as shown in FIG. 7. Upon pivotal rotation of latch cover 3, these cams engage the surface of the cover 52 of transport case 50 and provide a degree of resistance to further rotation, thereby holding latch cover 3 at a given position until further rotation is desired. Further rotation of latch cover 3 can be achieved by exerting sufficient force on it to overcome the resistance exerted by cam 22 against the surface of transport case 50 and to thereby rotate latch cover 3 so that cam 22 no longer engages the surface of transport case 50.

The trigger latch assembly of the current invention can be made of any suitable materials including plastics and metals. In a preferred embodiment the latch cover 3 and latch trigger 7 are made of a molded plastic such as polyethylene, and pivot rod 5, pivot pin 11, and biasing member 9 are made of suitable metals. In a further preferred embodiment, the latch cover 3 and latch trigger 7 components of the trigger latch assembly 1 are molded from the same type of plastic material as the transport case to which the trigger latch assembly is attached.

The configuration of the trigger latch assembly having been described, the operation of this invention will now be set out. When it is desired to latch closed the device to which trigger latch assembly 1 is attached, latch cover 3 is pivoted forward to the position shown in FIG. 4 such that a catch member, such as retaining lip 51 on the bottom portion 53 of case 50, contacts detent 21 on trigger engagement member 13. As force is exerted on the top forward surface 26 of latch cover 3, preferably by a person's fingers, the resulting pressure of retaining lip 51 against sloped surface 15 of detent 21 forces trigger engagement member 13 to pivot away slightly from lip 51 by compressing latch trigger biasing member 9, and thereby causes the forward portion 31 of latch trigger 7 to pivot towards latch cover 3 and reduces the acute angle between them, as shown in FIG. 5. The pivoting of trigger engagement member 13 away from lip 51 as pressure is applied to the top forward surface 26 of latch cover 3 permits lip 51 to slide along sloped surface 15 of detent 21, as illustrated in FIGS. 4 and 5. As additional force is exerted against the top forward surface 26 of latch cover 3, trigger engagement member 13 continues to pivot away from lip 51 and lip 51 continues to slide along sloped surface 15 of detent 21 until lip 51 moves past all of sloped surface 15 and passes latch protrusion 17, at which point lip 51 moves into the recess 19 above latch protrusion 17. The movement of the forward portion of lip 51 into recess 19 permits biasing member 9 to pivot latch trigger 7 downward away from the forward portion of latch cover 3 and moves trigger engagement member 13 towards lip 51 to force latch protrusion 17 securely under lip 51, as shown in FIG. 6, thereby closing the latch and securing case 50 closed. Preferably, an audible "click" can be heard when latch protrusion 17 is secured under lip 51, confirming that the latch has been fully engaged.

In a preferred embodiment, the cover 52 of transport case 50 has a flexible gasket 54 along its open edge, as shown in cross-section in FIG. 3. Flexible gasket 54 provides a seal for the case and also provides flexible resistance to the latching and closure of the case. In a further preferred embodiment, when the trigger latch assembly is latched, the top surface of latch cover 3 is flush with the exterior surfaces of the transport case, as shown in FIG. 6.

To disengage the trigger latch, forward portion 31 of latch trigger 7 is moved upward towards latch cover 3, such as by grasping the underside of forward portion 31 of latch trigger 7 with the fingers and grasping the top forward surface 26 of latch cover 3 with the thumb and pivotably compressing them together. As the forward portion 31 of latch trigger 7 pivots towards latch cover 3, the latch trigger 7 compresses biasing member 9 and pivots trigger engagement member 13 forward and away from retaining lip 51, thereby moving latch protrusion 17 out from under lip 51 and releasing the trigger latch to the unlatched position shown in FIGS. 4 and 5. The trigger latch assembly 1 can then be rotated to the fully open position shown in FIG. 3. Since direct action is required to move the forward portion of latch trigger 7 towards latch cover 3 in order to unlatch the trigger latch assembly, the risk of unintentional unlatching of the device is minimized while providing a latching device that is easy to latch and unlatch as desired.

While a preferred embodiment of this invention has been shown and described, it will be apparent to those skilled in the art that other modifications and embodiments can be constructed without departing from the inventive concepts herein. The invention, therefore, is not to be restricted except by the scope of claims that follow.

What is claimed is:

1. A trigger latch assembly for a case having two mating portions comprising:

a latch cover adapted for pivotal movement about a fixed pivot rod on a first of the two portions;

a latch trigger having forward and rear portions, said latch trigger being pivotally attached to the underside of said latch cover and adapted for pivotal movement between at least first and second positions about a pivot pin on the latch cover;

a latch trigger biasing member attached to said pivot pin and engaging both said latch trigger and said latch cover and biasing the forward portion of said latch trigger away from said latch cover, the underside of the forward portion of the latch trigger providing a finger actuator surface; and said latch trigger further comprising a generally perpendicularly extending trigger engagement member having a detent for releasable engagement with a catch on the second portion to be latched to the first portion, the engagement member moving the second portion together with the first portion to latch the two portions together, said trigger engagement member and detent pivotably movable away from the catch when the forward portion of the latch trigger is moved towards the latch cover by compression of the latch trigger biasing member.

2. A transport case comprising first and second portions, and a trigger latch assembly attached to the first portion of the transport case, said trigger latch assembly comprising:

a latch cover pivotably secured to the first portion of the transport case, said latch cover having a top surface and an underside surface;

a latch trigger pivotally attached to the underside surface of said latch cover and having a forward portion and a rear portion, the underside of the forward portion providing a finger actuator surface, and the latch trigger further having a perpendicularly extending latch member;

a latch trigger biasing member attached to said latch trigger and engaging said latch cover and said latch trigger, same said biasing member biasing the forward portion of the latch trigger away from the latch cover; and a detent formed on said latch member for releasable engagement with a lip on the second portion of the transport case, the engagement latch member moving the second portion together with the first portion to latch the two portions together, said detent being movable into latching engagement with the lip when force is applied to the top surface of the latch cover and being further biased into latching engagement with the lip by the biasing member, and said detent being movable away from engagement with the lip when the forward portion of the latch trigger is pivotably moved towards the latch cover.

3. The transport case of claim 2 wherein at least two trigger latch assemblies are attached to the transport case.

4. The transport case of claim 2 wherein the first and second portions of the case are attached together on one side of the case by a hinge, and two or more trigger latch assemblies are attached to the case on one or more of the unhinged sides of the case.

* * * * *